US011702773B2

(12) United States Patent
Nukui et al.

(10) Patent No.: US 11,702,773 B2
(45) Date of Patent: Jul. 18, 2023

(54) GLASS ROVING CLOTH AND GLASS-FIBER-REINFORCED RESIN SHEET

(71) Applicant: NITTO BOSEKI CO., LTD., Fukushima (JP)

(72) Inventors: Yosuke Nukui, Fukushima (JP); Junya Sakata, Gunma (JP); Hideaki Monma, Fukushima (JP)

(73) Assignee: Nitto Boseki Co., Ltd., Fukushima (JP)

( * ) Notice: Subject to any disclaimer, the term of this patent is extended or adjusted under 35 U.S.C. 154(b) by 168 days.

(21) Appl. No.: 17/600,712

(22) PCT Filed: Mar. 17, 2020

(86) PCT No.: PCT/JP2020/011827
§ 371 (c)(1),
(2) Date: Oct. 1, 2021

(87) PCT Pub. No.: WO2021/002066
PCT Pub. Date: Jan. 7, 2021

(65) Prior Publication Data

US 2022/0170186 A1 Jun. 2, 2022

(30) Foreign Application Priority Data

Jul. 2, 2019 (JP) ..... 2019-123341

(51) Int. Cl.

| | |
|---|---|
| ***D03D 15/267*** | (2021.01) |
| ***D03D 15/50*** | (2021.01) |
| ***D02G 3/18*** | (2006.01) |
| ***D02G 3/22*** | (2006.01) |
| ***D03D 13/00*** | (2006.01) |
| *D03D 25/00* | (2006.01) |

(52) U.S. Cl.
CPC ..... *D03D 15/267* (2021.01); *D02G 3/18* (2013.01); *D02G 3/22* (2013.01); *D03D 13/008* (2013.01); *D03D 15/50* (2021.01); *D10B 2101/06* (2013.01)

(58) Field of Classification Search
CPC .... D03D 15/267; D03D 13/008; D03D 15/50; D02G 3/18; D02G 3/22; D10B 2101/06; B29B 15/08; B29C 70/22
See application file for complete search history.

(56) References Cited

U.S. PATENT DOCUMENTS

| | | | | |
|---|---|---|---|---|
| 2,836,529 | A * | 5/1958 | Morris | B29C 70/22 442/187 |
| 5,206,078 | A * | 4/1993 | Inoguchi | H05K 1/0366 442/212 |
| 5,401,564 | A * | 3/1995 | Lee | A43B 7/226 428/113 |
| 5,732,748 | A * | 3/1998 | Aucagne | D03D 15/275 26/99 |
| 8,980,417 | B2 * | 3/2015 | Adachi | D03D 15/267 65/444 |
| 9,068,284 | B2 * | 6/2015 | Jung | D03D 15/46 |
| 2001/0002971 | A1 * | 6/2001 | Kittson | D03D 15/56 405/21 |
| 2003/0024592 | A1 * | 2/2003 | Serillon | D06C 13/00 139/421 |
| 2004/0142618 | A1 * | 7/2004 | Porter | E04C 2/043 428/210 |
| 2005/0009428 | A1 * | 1/2005 | Porter | C04B 14/42 442/72 |
| 2005/0136758 | A1 * | 6/2005 | Newton | B29C 70/22 442/180 |
| 2012/0064788 | A1 * | 3/2012 | Peters | C08J 5/043 442/205 |

FOREIGN PATENT DOCUMENTS

| | | | |
|---|---|---|---|
| JP | H03-159742 | A | 7/1991 |
| JP | H09-324340 | A | 12/1997 |
| JP | 2005-330114 | A | 12/2005 |
| JP | 2012-506477 | A | 3/2012 |
| JP | 2013-049945 | A | 3/2013 |

* cited by examiner

*Primary Examiner* — Robert H Muromoto, Jr.
(74) *Attorney, Agent, or Firm* — Carrier, Shende and Associates, P.C.; Joseph P. Carrier; Fulchand P. Shende

(57) ABSTRACT

The glass roving cloth includes glass rovings each composed of glass filaments, each having a filament diameter Dt of 9.5 to 30.0 μm, bundled in a number bundled Ft of 400 to 8000 as a warp yarn and glass rovings each composed of glass filaments, each having a filament diameter Dy of 9.5 to 30.0 μm, bundled in a number bundled Fy of 400 to 8000 as weft yarns, wherein the weaving density of the warp yarns and weft yarn is 2.0 to 14.0 yarns/25 mm, the average yarn width of the warp yarn and the weft yarn are each 500 to 8000 μm, the widening rate of the warp yarn and the weft yarn are each 3.0 to 30.0%, the glass occupancy in the warp yarn direction is 90.0 to 106.0%, and the glass occupancy in the weft yarn direction is 75.0 to 99.0%.

6 Claims, No Drawings

GLASS ROVING CLOTH AND GLASS-FIBER-REINFORCED RESIN SHEET

TECHNICAL FIELD the present invention relates to a glass roving cloth and a glass fiber-reinforced resin sheet.

BACKGROUND ART

Conventionally, glass fiber products have been widely used in various applications to improve the performance of resin products. Among glass fiber products, use of fabrics composed of glass rovings (glass fiber yarns each composed of 100 to 10000 glass filaments each having a filament diameter of 3 to 30 μm bundled) as warp yarns and weft yarns (glass roving cloths) as reinforcing materials for glass fiber-reinforced resin sheets for use in printed wiring boards has been contemplated (e.g., see Patent Literature 1). In the glass roving cloth described in Patent Literature 1, in order to enable thinner and flatter printed wiring boards requested in the market to be produced, the widening rate (=100×yarn width of a glass roving in glass roving cloth/(diameter of glass filaments constituting the glass roving×number of the glass filaments constituting the glass roving); unit: %) is required to be an extremely high value (e.g., 88.5% or more).

CITATION LIST

Patent Literature

Patent Literature 1: Japanese Patent Laid-Open No. 2005-330114

SUMMARY OF INVENTION

Technical Problem

Use of glass fiber-reinforced resin sheets as metal substitute materials in the automotive industry field has expanded recently. In the automotive industry field, glass fiber-reinforced resin sheets are required to have high mechanical strength (e.g., bending strength and flexural modulus) in order to achieve the safety of drivers and durability of parts. Since automotive parts has various shapes, glass fiber-reinforced resin sheets for use in automotive parts and glass fiber products as a reinforcing material therefor are required to have an excellent shape-imparting property. Further, in accordance with high productivity of automobiles, high productivity of glass fiber-reinforced resin sheets for use in automotive pans is also required. For example, in the production stage of glass roving cloths, such glass roving cloths are required to have high weaving performance, and in the production stage of glass fiber-reinforced resin sheets, such glass roving cloths are required to have high resin impregnability.

These characteristics are not necessarily required in printed wiring boards, or the level required in printed wiring boards is different from that in automotive parts. Thus, glass fiber-reinforced resin sheets for use in printed wiring boards and glass roving cloths as a reinforcing material therefor have been insufficient in these characteristics.

The present invention has been made in view of the above situation, and an object thereof is to provide a glass roving cloth that comprises excellent weaving performance and excellent resin impregnability and can achieve a glass fiber-reinforced resin sheet comprising high mechanical strength and an excellent shape-imparting property, and a glass fiber-reinforced resin sheet including this glass roving cloth and comprising high mechanical strength and an excellent shape-imparting property.

Solution to Problem

In order to achieve the object, a glass roving cloth of the present invention comprising glass rovings each composed of glass filaments, each having a filament diameter Dt in the range of 9.5 to 30.0 μm, bundled in a number bundled Ft in the range of 400 to 8000 as warp yarns and glass rovings each composed of glass filaments, each having a filament diameter Dy in the range of 9.5 to 30.0 μm, bundled in a number bundled Fy in the range of 400 to 8000 as weft yarns, wherein the weaving density of the warp yarns Wt and the weaving density of the weft yarns Wy are each in the range of 2.0 to 14.0 yarns/25 mm, the warp yarn average yarn width Bt and the weft yarn average yarn width By are each in the range of 500 to 8000 m, the warp yarn widening rate Et (100×Bt/(Dt×Ft)) and the weft yarn widening rate Ey (100×By/(Dy×Fy)) are each in the range of 3.0 to 30.0%, the glass occupancy in the warp yarn direction Mt (100×Bt/(25000 (μm)/Wt)) is in the range of 90.0 to 106.0%, and the glass occupancy in the weft yarn direction My (100×By/(25000 (μm)/Wy)) is in the range of 75.0 to 99.0%.

The glass roving cloth of the present invention comprises excellent weaving performance and excellent resin impregnability because of having the Dt, Dy, Ft, Fy, Wt, Wy, Bt, By, Et, Ey, Mt, and My each in the range described above, and high mechanical strength and an excellent shape-imparting property are achieved by a glass fiber-reinforced resin sheet including the glass roving cloth. Here, high mechanical strength means that the bending strength of the glass fiber-reinforced resin sheet is 600 MPa or more and the flexural modulus thereof is 20.0 GPa or more.

In the glass roving cloth of the present invention, when the filament diameter Dt of the glass filaments constituting the glass roving as the warp yarn and the filament diameter Dy of the glass filaments constituting the glass roving as the weft yarn are each less than 9.5 μm, the weaving performance of glass roving cloth is degraded. In contrast, in the glass roving cloth of the present invention, when the Dt and Dy are each more than 30.0 μm, the resin impregnability of the glass roving cloth is degraded.

In the glass roving cloth of the present invention, when the number of the glass filaments Ft constituting the glass roving as the warp yarn and the number of the glass filament Fy constituting the glass roving as the weft yarn are each less than 400, the weaving performance of the glass roving cloth is degraded. In contrast, in the glass roving cloth of the present invention, when the Ft and Fy are each more than 8000, the resin impregnability of the glass roving cloth is degraded.

In the glass roving cloth of the present invention, it is difficult to weave a glass roving cloth having a weaving density of the warp yarns Wt and a weaving density of the weft yarns Wy of less than 2.0 yarns/25 mm. In contrast, in the glass roving cloth of the present invention, when the Wt and Wy are each more than 14.0 yarns/25 mm, the resin impregnability of the glass roving cloth is degraded.

In the glass roving cloth of the present invention, when the warp yarn average yarn width Bt and weft yarn average yarn width By are each less than 500 μm, the resin impregnability of the glass roving cloth is degraded. In contrast, when the Bt and By are each more than 8000 μm, the weaving performance of the glass roving cloth is degraded.

In the glass roving cloth of the present invention, when the warp yarn widening rate Et calculated by 100×Bt/(Dt×Ft) and the weft yarn widening rate Ey calculated by 100×By/(Dy×Fy) based on the Dt, Dy, Ft, Fy, Bt, and By are each less than 3.0%, the resin impregnability of the glass roving cloth is degraded. In contrast, when the Et and Ey are each more than 30.0%, the weaving performance of the glass roving cloth is degraded.

In the glass roving cloth of the present invention, when the glass occupancy in the warp yarn direction Mt calculated by 100×Bt/(25000 (μm)/Wt) based on the Bt and Wt is less than 90.0%, a glass fiber-reinforced resin sheet including the glass roving cloth of the present invention does not comprises sufficient mechanical strength, and the shape-imparting property of the glass fiber-reinforced resin sheet deteriorates. In contrast, when the Mt is more than 106.0%, the weaving performance of the glass roving cloth deteriorates.

In the glass roving cloth of the present invention, when the glass occupancy in the weft yarn direction My calculated by 100×By/(25000 (μm)/Wy) based on the By and Wy is less than 75.0%, a glass fiber-reinforced resin sheet including the glass roving cloth of the present invention does not comprise sufficient mechanical strength. In contrast, when the My is more than 99.0%, the weaving performance of the glass roving cloth deteriorates.

In the glass roving cloth of the present invention, it is preferred that the Mt be in the range of 98.0 to 105.0% and the My be in the range of 80.0 to 98.0%.

The glass roving cloth of the present invention comprises excellent weaving performance and excellent resin impregnability because the Mt and My are each in the range described above, and higher mechanical strength and an excellent shape-imparting property are achieved by a glass fiber-reinforced resin sheet including the glass roving cloth. Here, higher mechanical strength means that the bending strength of the glass fiber-reinforced resin sheet is 600 MPa or more and the flexural modulus thereof is 20.5 ON or more.

The glass roving cloth of the present invention preferably has a loss on ignition of 0.16 to 0.30%.

The glass roving cloth of the present invention comprises extremely excellent weaving performance and excellent resin impregnability because the Mt is in the range of 98.0 to 105.0%, the My is in the range of 80.0 to 98.0%, and the loss on ignition in the range described above, and extremely high mechanical strength and excellent shape-imparting property are achieved by a glass fiber-reinforced resin sheet including the glass roving cloth. Here, extremely high mechanical strength means that the bending strength of the glass fiber-reinforced resin sheet is 630 MPa or more and the flexural modulus thereof is 20.5 GPa or more.

In the glass roving cloth of the present invention, the Et and Ey are preferably each in the range of 7.0 to 11.4%.

The glass roving cloth of the present invention more securely achieves excellent weaving performance and excellent resin impregnability because the Et and Ey are in the range described above.

The glass fiber-reinforced resin sheet of the present invention includes the glass roving cloth of the present invention described above.

In the glass fiber-reinforced resin sheet of the present invention, the proportion by mass of the glass roving cloth based on the total amount of the glass fiber-reinforced resin sheet is preferably 50.0 to 85.0% by mass.

According to the glass fiber-reinforced resin sheet of the present invention, high mechanical strength and excellent shape-imparting property are more securely achieved because the proportion by mass of the glass roving based on the total amount of the glass fiber-reinforced resin sheet is in the range described above.

DESCRIPTION OF EMBODIMENTS

Hereinafter, embodiments of the present invention will be described in more detail.

The glass roving cloth of the present embodiment comprises glass rovings each composed of glass filaments, each having a filament diameter Dt in the range of 9.5 to 30.0 μm, bundled in a number bundled Ft in the range of 400 to 8000 as warp yarns and glass rovings each composed of glass filaments, each having a filament diameter Dy in the range of 9.5 to 30.0 μm, bundled in a number bundled Fy in the range of 400 to 8000 as weft yarns, wherein the weaving density of the warp yarns Wt and the weaving density of the weft yarns Wy are each in the range of 2.0 to 14.0 yarns/25 mm, the warp yarn average yarn width Bt and the weft yarn average yarn width By are each in the range of 500 to 8000 μm, the warp yarn widening rate Et (100×Bt/(Dt×Ft)) and the weft yarn widening rate Ey (100×By/(Dy×Fy)) are each in the range of 3.0 to 30.0%, the glass occupancy in the warp yarn direction Mt (100×Bt/(25000 (μm)/Wt)) is in the range of 90.0 to 106.0%, and the glass occupancy in the weft yarn direction My (100×By/(25000 (μm)/Wy)) is in the range of 75.0 to 99.0%.

The glass roving cloth of the present embodiment comprises excellent weaving performance and excellent resin impregnability because the Dt, Dy, Ft, Fy, Wt, Wy, Et, Ey, Mt, and My are each in the range described above, and high mechanical strength and an excellent shape-imparting property are achieved by a glass fiber-reinforced resin sheet including the glass roving cloth. Here, high mechanical strength means that the bending strength of the glass fiber-reinforced resin sheet is 600 MPa or more and the flexural modulus thereof is 20.0 GPa or more.

In the present invention, the bending strength and the flexural modulus each can be measured by the following methods. Apparatuses for use in measurement are not particularly limited as long as having performance equivalent to that of the apparatuses described below.

[Bending Strength, Flexural Modulus]

The bending strength and flexural modulus are measured in compliance with JIS K 7017:1999 (method A, class III test piece) by a precision universal tester (manufactured by Shimadzu Corporation, trade name: Autograph AG-5000B).

In the glass roving cloth of the present embodiment, from the viewpoint of achieving both the weaving performance and the resin impregnability of the glass roving cloth, the Dt and Dy are each preferably in the range of 10.5 to 25.0 μm, more preferably in the range of 13.0 to 20.0 μm, and further preferably in the range of 15.0 to 18.0 μm.

In the glass roving cloth of the present embodiment, the Dt and Dy can be measured in compliance with JIS R3420: 2013. The glass roving cloth having no organic matter including resin attached thereto can be removed from the glass fiber-reinforced resin sheet by heating the glass fiber-reinforced resin sheet in a muffle furnace at 300 to 600° C. for about 2 to 24 hours. This glass roving cloth can be used to measure the Dt and Dy.

In the glass roving cloth of the present embodiment, the Dt and Dy may be the same or different.

In the glass roving cloth of the present embodiment, from the viewpoint of achieving both the weaving performance and the resin impregnability of the glass roving cloth, the Ft and Fy is preferably in the range of 800 to 6000, more preferably in the range of 1000 to 5000, and further preferably in the range of 1500 to 4500.

In the glass roving cloth of the present embodiment, the Ft and Fy can be determined by subjecting the cross section of each of at least 5 glass rovings either as the warp yarns or weft yarns in the glass roving cloth to analysis by an image processing apparatus or observation by a scanning electron microscope to count the number of glass filaments constituting each of the glass rovings, and taking the averages thereof. The glass roving cloth having no organic matter including resin attached thereto can be removed from the glass fiber-reinforced resin sheet by heating the glass fiber-reinforced resin sheet in a muffle furnace at 300 to 600° C. for about 2 to 24 hours. This glass roving cloth can be used to measure the Ft and Fy.

In the glass roving cloth of the present embodiment, the Ft and Fy may be the same or different.

In the glass roving cloth of the present embodiment, the warp yarn and weft yarn have, for example, a weight of in the range of 75 to 15000 tex (g/1000 m), preferably a weight in the range of 100 to 9600 tex, more preferably a weight in the range of 150 to 4800 tex, further preferably a weight in the range of 500 to 2500 tex, and particularly preferably a weight in the range of 700 to 2000 tex. In the glass roving cloth of the present embodiment, the weights of the warp yarn and the weft yarn may be the same or different.

The weights of the warp yarn and the weft yarn in the glass roving cloth of the present embodiment can be measured in compliance with JIS R3420:2013. The glass roving cloth having no organic matter including resin attached thereto can be removed from the glass fiber-reinforced resin sheet by heating the glass fiber-reinforced resin sheet in a muffle furnace at 300 to 600° C. for about 2 to 24 hours. This glass roving cloth can be used to measure the weights of the warp yarn and the weft yarn in the glass roving cloth.

In the glass roving cloth of the present embodiment, from the viewpoint of achieving both the weaving performance and the resin impregnability of the glass roving cloth, the Wt and Wy are each preferably in the range of 3.0 to 10.0 yarns/25 mm, more preferably in the range of 3.5 to 9.0 yarns/25 mm, further preferably in the range of 3.7 to 8.0 yarns/25 mm. In the glass roving cloth of the present embodiment, the Wt and Wy may be the same or different.

In the glass roving cloth of the present embodiment, the Wt and Wy can be measured in compliance with JIS R3420:2013. The glass roving cloth having no organic matter including resin attached thereto can be removed from the glass fiber-reinforced resin sheet by heating the glass fiber-reinforced resin sheet in a muffle furnace at 300 to 600° C. for about 2 to 24 hours. This glass roving cloth can be used to measure the Wt and Wy.

In the glass roving cloth of the present embodiment, as for the Wt and Wy, Wy/Wt can be in the range of 0.50 to 2.00. Wy/Wt is preferably in the range of 0.60 to 1.20, more preferably in the range of 0.70 to 1.00, and further preferably in the range of 0.75 to 0.94 because of excellent handleability in use of the glass roving cloth.

In the glass roving cloth of the present embodiment, from the viewpoint of achieving both the weaving performance and the resin impregnability of the glass roving cloth, the Bt and By are each preferably in the range of 1000 to 7000 μm, more preferably in the range of 1800 to 6500 μm, and further preferably in the range of 2500 to 6000 μm. In the glass roving cloth of the present embodiment, the Bt and By may be the same or different.

In the present embodiment, the Bt and By each can be determined by measuring the yarn width at least 5 or more points in each of at least 5 glass rovings either as the warp yarns or weft yarns in the glass roving cloth with a ruler and taking the average of the widths. The glass roving cloth having no organic matter including resin attached thereto can be removed from the glass fiber-reinforced resin sheet by heating the glass fiber-reinforced resin sheet in a muffle furnace at 300 to 600° C. for about 2 to 24 hours. This glass roving cloth can be used to measure the Bt and By.

In the glass roving cloth of the present embodiment, the Bt and By can be controlled by adjusting the filament diameter and the number of filaments bundled of the glass rovings as the warp yarns and weft yarns, the weaving density and woven structure of the warp yarns and weft yarns, the tension conditions applied to the warp yarns on weaving, the weft yarn beating conditions on weaving, the conditions for opening treatment using high-pressure water stream or ultrasound that may be conducted after weaving, and the like.

In the glass roving cloth of the present embodiment, as for the Bt and By, By/Bt can be in the range of 0.50 to 2.00. From the viewpoint of securing the handleability and resin impregnability of the glass roving cloth and the isotropy of the glass fiber-reinforced resin sheet, By/Bt is preferably in the range of 0.70 to 1.30, more preferably in the range of 0.80 to 1.20, and further preferably in the range of 0.90 to 1.10.

In the glass roving cloth of the present embodiment, from the viewpoint of achieving both the weaving performance and the resin impregnability of the glass roving cloth, the Et and Ey are each preferably in the range of 5.0 to 20.0%, more preferably in the range of 6.0 to 15.0%, and further preferably in the range of 7.0 to 11.4%.

In the glass roving cloth of the present embodiment, since higher mechanical strength is achieved in the glass fiber-reinforced resin sheet including the glass roving cloth, it is preferred that the Mt be in the range of 98.0 to 105.0% and the My be in the range of 80.0 to 98.0%, it is more preferred that the Mt be in the range of 98.5 to 104.5% and the My be in the range of 85.0 to 97.0%, and it is further preferred that the Mt be in the range of 99.0 to 104.0% and the My be in the range of 90.0 to 96.0%.

In the glass roving cloth of the present embodiment, as long as the Et, Ey, Mt, and My are achieved, the woven structure is not limited, and for example, plain weaving, twill weaving, and satin weaving may be employed. Among these, as the woven structure of the glass roving cloth of the present embodiment, twill weaving can be preferably employed, 2/2 twill weaving or ⅓ twill weaving can be more preferably employed, and 2/2 twill weaving can be further preferably employed.

The glass roving cloth of the present embodiment may comprise a thickness in the range of 50 to 1500 μm. From the viewpoint of achieving the mechanical strength and shape-imparting property of the glass fiber-reinforced resin sheet including the glass roving cloth of the present embodiment, the glass roving cloth of the present embodiment preferably comprises a thickness in the range of 75 to 1200 μm, more preferably comprises a thickness in the range of 200 to 1000 μm, and further preferably comprises a thickness in the range of 300 to 900 μm.

The thickness of the glass roving cloth of the present embodiment can be measured in compliance with JIS R3420:2013. The glass roving cloth having no organic matter including resin attached thereto can be removed from the glass fiber-reinforced resin sheet by heating the glass fiber-reinforced resin sheet in a muffle furnace at 300 to 600° C. for about 2 to 24 hours. This glass roving cloth can be used to measure the thickness of the glass roving cloth.

The glass roving cloth of the present embodiment may comprise a mass per unit area in the range of 50 to 1500 g/m$^2$. From the viewpoint of achieving the mechanical strength and shape-imparting property of the glass fiber-reinforced resin sheet including the glass roving cloth of the present embodiment, the glass roving cloth of the present embodiment preferably comprises a mass per unit area in the range of 75 to 1200 g/m$^2$, more preferably comprises a mass per unit area in the range of 200 to 1000 g/m$^2$, and further more preferably comprises a mass per unit area in the range of 300 to 900 g/m$^2$.

The mass per unit area of the glass roving cloth of the present embodiment can be measured in compliance with JIS R3420:2013. The glass roving cloth having no organic matter including resin attached thereto can be removed from the glass fiber-reinforced resin sheet by heating the glass fiber-reinforced resin sheet in a muffle furnace at 300 to 600° C. for about 2 to 24 hours. This glass roving cloth can be used to measure the mass per unit area of the glass roving cloth.

The glass roving cloth of the present embodiment may be surface-treated with organic matter from the viewpoint of enhancement in adhesion with the resin and prevention of raveling of the glass rovings.

Examples of organic matter that can be used in surface treatment of the glass roving cloth of the present embodiment can include silane coupling agents, resin emulsions, and surfactants.

Examples of silane coupling agents can include amino silanes, vinyl silanes, epoxy silanes, methacrylic silanes, cationic silanes, acrylic silanes, phenyl silanes, halogeno silanes, ureido silanes, mercapto silanes, sulfide silanes, isocyanate silanes, isocyanurate silanes, and styryl silanes. As the silane coupling agent, these can be used singly or in combination of two or more.

Examples of the amino silane can include 3-aminopropyltrimethoxysilane, 3-aminopropyltriethoxysilane, 3-(2-aminoethyl)aminopropyltrimethoxysilane, ureidopropyltrimethoxysilane, ureidopropyltriethoxysilane, N-2-(aminoethyl)-3-aminopropyltrimethoxysilane, and N-2-(aminoethyl)-3-aminopropylmethyldimethoxysilane.

Examples of the vinyl silane can include vinyltrimethoxysilane, vinyltriethoxysilane, vinylacetoxysilane, allyltrimethoxysilane, 3-methacryloxypropyltrimethoxysilane, 3-methacryloxypmpyltriethoxysilane, 3-methacryloxypropylmethyldimethoxysilane, 3-methacryloxypropylmethyldiethoxysilane, and 3-acryloxypropyltrimethoxysilane.

Examples of the epoxy silane can include 3-glycidoxypropyltrimethoxysilane, 3-glycidoxypropyltriethoxysilane, 3-glycidoxypropylmethyldimethoxysilane, 3-glycidoxypropylmethyldiethoxysilane, and 2-(3,4-epoxycyclohexyl)ethyltrimethoxysilane.

Examples of the methacrylic silane can include 3-methacryloxypropylmethyldienthoxysilane, 3-methacryloxypropyltrimethoxysilane, 3-methacryloxypropylmethyldiethoxysilane, and 3-methacryloxypropyltriethoxysilane.

Examples of the cationic silane can include N-β-(N-vinylhenzylaminoethyl)-γ-aminopropyltrimethoxysilane hydrochloride, N-2-(aminoethyl)-3-aminopropylmethyldimethoxysilane hydrochloride, N-2-(aminoethyl)-3-aminopropyltrimethoxysilane hydrochloride, 3-aminopropyltrimethoxysilane hydrochloride, 3-aminopropyltriethoxysilane hydrochloride, 3-triethoxysilyl-N-(1,3-dimethylbutylidene)propylamine hydrochloride, and N-phenyl-3-aminopropyltrimethoxysilane hydrochloride.

Examples of the acrylic silane can include 3-acryloxypropylrimethoxysilane.

Examples of the phenyl silane can include trimethoxyphenylsilane and triethoxyphenylsilane.

Examples of the halogeno silane can include (3-chloropmpyl)trimethoxysilane and (3-chlompropyl)triethoxysilane.

Examples of the urmido silane can include 3-ureidopropyltriethoxysilane.

Examples of the mercapto silane can include γ-mercaptopropyltrimethoxysilane.

Examples of the sulfide silane can include bis(3-(triethoxysilyl)propyl)disulfide or bis(3-(triethoxysilyl)propyl)tetrasulfide.

Examples of the isocyanate silane can include 3-isocyanatepropyltriethoxysilane.

Examples of the isocyanurate silane can include tris (trimethoxysilylpropyl)isocyanurate.

Examples of the styryl silane can include styryltrimethoxysilane.

Among these, amino silanes can be preferably used because of being particularly excellent in adhesion with thermoplastic resins.

Examples of resin emulsions can include vinyl acetate resin emulsions, ethylene—vinyl acetate copolymer resin emulsions, acrylic resin emulsions, polystyrene resin emulsions, HIPS resin emulsion, AS resin emulsions, ABS resin emulsions, ACS resin emulsions, AES resin emulsions, AAS resin emulsions, MBS resin emulsions, bisphenol A-type epoxy resin emulsions, bisphenol F-type epoxy resin emulsions, bisphenol A—bisphenol F co-condensation-type epoxy resin emulsions, novolac-type epoxy resin emulsions, biphenyl-type epoxy resin emulsions, and dicyclopentadiene—phenolic co-condensation-type epoxy resin emulsions. As the resin emulsion, these can be used singly or in combinations of two or more.

Examples of the surfactant can include nonionic surfactants, cationic surfactants, anionic surfactants, and amphoteric surfactants. As the surfactant, these compounds can be used singly or in combination of two or more.

Examples of the nonionic surfactant can include ethylene oxide propylene oxide alkyl ether, polyoxyethylene alkyl ether, polyoxyethylene-polyoxypropylene-block copolymer, alkyl polyoxyethylene-polyoxypropylene block copolymer ether, polyoxyethylene fatty acid ester, polyoxyethylene fatty acid monoester, polyoxyethylene fatty acid diester, polyoxyethylene sorbitan fatty acid ester, glycerol fatty acid ester ethylene oxide adduct, polyoxyethylene castor oil ether, hydrogenated castor oil ethylene oxide adduct, alkylamine ethylene oxide adduct, fatty acid amide ethylene oxide adduct, glycerol fatty acid ester, polyglycerol fatty acid ester, pentaerythritol fatty acid ester, sorbitol fatty acid ester, sorbitan fatty acid ester, sucrose fatty acid ester, polyhydric alcohol alkyl ether, fatty acid alkanolamide, acetylene glycol, acetylene alcohol, ethylene oxide adduct of acetylene glycol, and ethylene oxide adducts of acetylene alcohol.

Examples of the cationic surfactant can include alkyldimethylbenzylammonium chloride, alkylrimethylammonium chloride, alkyl dimethyl ethyl ammonium ethyl sulfate, higher alkylamine salts (such as acetate and hydrochloride), adduct of ethylene oxide to a higher alkylamine, condensate of a higher fatty acid and polyalkylene polyarn ine, a salt of an ester of a higher fatty acid and alkanolamine, a salt of higher fatty acid amide, imidazoline cationic surfactant, and alkyl pyridinium salts.

Examples of the anionic surfactant can include higher alcohol sulfate salts, higher alkyl ether sulfate salts, α-olefin sulfate salts, alkylbenzene sulfonate salts, α-olefin sulfonate salts, reaction products of fatty acid halide and N-methyl taurine, dialkyl sulfosuccinate salts, higher alcohol phosphate ester salts, and phosphate ester salts of higher alcohol ethylene oxide adducts.

Examples of the amphoteric surfactant can include amino acid amphoteric surfactants such as alkali metal salts of alkylaminopropionic acid, betaine amphoteric surfactants such as alkyldimethylbetaine, and imidazoline amphoteric surfactants.

The glass roving cloth of the present embodiment can be surface-treated with organic matter by, for example, applying, to glass rovings, a treatment liquid including the organic matter as a sizing agent or a binder during production of the glass rovings described below. The glass roving cloth may be surface-treated also by impregnating a glass roving cloth after weaving in a treatment bath comprising a treatment liquid including organic matter and then drying the glass roving cloth.

In the case where the glass roving cloth of the present embodiment is surface-treated with organic matter, the loss on ignition may be in the range of 0.05 to 0.50%, for example. The loss on ignition of the glass roving cloth of the present embodiment is preferably in the range of 0.16 to 0.30% because both extremely excellent weaving performance and excellent resin impregnability can be achieved and extremely high mechanical strength and excellent shape-imparting property are achieved in the glass fiber-reinforced resin sheet including the glass roving cloth.

In the glass roving cloth of the present embodiment, the loss on ignition of the glass roving cloth can be measured in compliance with JIS R3420:2013.

The glass roving cloth of the present embodiment comprises extremely excellent weaving performance and excellent resin impregnability because the Mt is in the range described above, the My is in the range described above, and the loss on ignition in the range described above, and extremely high mechanical strength and excellent shape-imparting property are achieved by a glass fiber-reinforced resin sheet including the glass roving cloth. Here, extremely high mechanical strength means that the bending strength of the glass fiber-reinforced resin sheet is 630 MPa or more and the flexural modulus thereof is 20.5 GPa or more.

The glass roving cloth of the present embodiment may be surface-treated with inorganic matter.

Examples of the inorganic matter that can be used in surface treatment of the glass roving cloth of the present embodiment can include colloidal silica.

The glass roving cloth of the present embodiment can be surface-treated with inorganic matter in the same manner as the surface treatment with organic matter.

In the glass roving cloth of the present embodiment, the glass composition of glass fiber forming the glass rovings as the warp yarns and weft yarns is not particularly limited. In the glass roving cloth of the present embodiment, examples of the glass composition that may be taken by the glass fiber can include the most common E glass composition (composition including $SiO_2$ in the range of 52.0 to 56.0% by mass, $Al_2O_3$ in the range of 12.0 to 16.0% by mass, MgO and CaO in the range of 20.0 to 25.0% by mass in total, and $B_2O_3$ in the range of 5.0 to 10.0% by mass, converted in terms of oxide, with respect to the total amount of the glass fiber), a high strength and high modulus glass composition (composition including $SiO_2$ in the range of 64.0 to 66.0% by mass, $Al_2O_3$ in the range of 24.0 to 26.0% by mass, and MgO in the range of 9.0 to 11.0% by mass, with respect to the total amount of the glass fiber), a high modulus and easily-producible glass composition (composition including $SiO_2$ in the range of 57.0 to 60.0% by mass, $Al_2O_3$ in the range of 17.5 to 20.0% by mass, MgO in the range of 8.5 to 12.0% by mass, CaO in the range of 10.0 to 13.0% by mass, and $B_2O_3$ in the range of 0.5 to 1.5% by mass, and $SiO_2$, $Al_2O_3$, MgO, and CaO of 98.0% by mass or more in total, with respect to the total amount of the glass fiber), and a low dielectric constant and low dielectric tangent glass composition (composition including $SiO_2$ in the range of 48.0 to 62.0% by mass, $B_2O_3$ in the range of 17.0 to 26.0% by mass, $Al_2O_3$ in the range of 9.0 to 18.0% by mass, CaO in the range of 0.1 to 9.0% by mass, MgO in the range of 0 to 6.0% by mass, $Na_2O$, $K_2O$, and $Li_2O$ in the range of 0.05 to 0.5% by mass in total, $TiO_2$ in the range of 0 to 5.0% by mass, SKO in the range of 0 to 6.0% by mass, $F_2$ and $Cl_2$ in the range of 0 to 3.0% by mass in total, and $P_2O_5$ in the range of 0 to 6.0% by mass, with respect to the total amount of the glass fiber). From the viewpoint of enhancing the mechanical strength of the glass fiber-reinforced resin sheet including the glass roving cloth, the glass composition of the glass fiber is preferably the high strength and high modulus glass composition or the high modulus and easily-producible glass composition.

Regarding measurement of the content of each component described above in the glass fiber constituting the glass roving cloth of the present embodiment, the content of Li as the light element can be measured with an ICP emission spectroscopic analyzer, and the contents of the other elements can be measured with a wavelength dispersive X-ray fluorescence analyzer.

The measurement method is as follows. First, a glass batch (prepared by mixing glass raw material) or glass fiber (when organic matter adheres to the surface of the glass fiber, or when glass fiber is mainly included as a reinforcing material in organic matter (resin), the glass fiber is used after the organic matter is removed by, for example, heating for about 2 to 24 hours in a muffle furnace at 300 to 600° C.) is placed in a platinum crucible and melted with stirring while being held at a temperature of 1550° C. for 6 hours in an electric furnace to obtain a homogeneous molten glass. Next, the obtained molten glass is poured onto a carbon plate to produce a glass cullet, and then pulverized into powder. Regarding Li as a light element, glass powder is thermally decomposed with an acid and then quantitatively analyzed using an ICP emission spectroscopic analyzer. Regarding other elements, glass powder is molded into a disc shape by a pressing machine and then quantitatively analyzed using a wavelength dispersive X-ray fluorescence analyzer. These quantitative analysis results are converted in terms of oxides to calculate the content of each component and the total amount, and the above content (% by mass) of each component can be determined from these numerical values.

Glass rovings constituted by the glass fiber comprising the above glass composition are produced as follows. First, a glass raw material (glass batch) prepared to have the above composition, based on the content of components included in ores to be the glass raw material and each component and the amount of each component volatilized in the melting process, is supplied to a melting furnace and melted at a temperature in the range of 1450 to 1550° C., for example. Then, the melted glass batch (melted glass) is drawn from 400 to 8000 nozzle tips of a bushing controlled at a predetermined temperature and rapidly cooled to form glass filaments. Subsequently, the glass filaments formed am applied with a sizing agent or binder using an applicator as an application apparatus. While 400 to 8000 of the glass filaments are bundled using a bundling shoe, the glass filaments are wound on a tube at a high speed using a winding apparatus to obtain a glass roving (glass direct roving). Alternatively, the melted glass is drawn from 200 to 4000 nozzle tips of a bushing and rapidly cooled to form glass filaments. The glass filaments are applied with a sizing agent or binder. Then, 200 to 4000 of the glass filaments are bundled and wound on a tube to obtain a glass fiber strand. While unraveled from the tube, 2 to 40 of these glass fiber strands are aligned to also obtain a glass roving (glass bundled roving).

In the glass roving cloth of the present embodiment, from the viewpoint of enhancing the resin impregnability of the glass roving cloth, the glass rovings to be used as the warp yarns and weft yarns of the glass roving cloth of the present embodiment are preferably glass direct rovings.

The glass rovings to be used as the warp yarns and weft yarns of the glass roving cloth of the present embodiment may be twisted in the range of 0.01 to 0.20 twists/25 mm, more preferably in the range of 0.03 to 0.18 twists/25 mm, and further preferably in the range of 0.05 to 0.15 twists/25 mm. The number of twists of the glass rovings here can be measured in compliance with JIS R3420:2013.

The glass roving cloth of the present embodiment can be produced by weaving the glass rovings described above as the warp yarns and weft yarns by a known loom such as a rapier loom under known conditions so as to achieve the weaving density and woven structure described above.

In the glass roving cloth of the present embodiment, Bt and By can be adjusted by rewinding the glass roving before weaving using a rewinding machine. In order to set each of the Bt and By to a desired value, the glass roving cloth of the present embodiment after weaving can be subjected to opening treatment by means of water flow pressure, opening treatment by means of high-frequency vibration using a liquid as a medium, opening treatment by means of the pressure of a fluid having a surface pressure, or opening treatment by means of pressing with a roll, for example. Among these opening treatments, opening by means of water flow pressure or opening by means of high-frequency vibration using a liquid as a medium is preferably used because variations in the yarn width after the opening treatment can be reduced in each of the warp yarns and weft yarns.

The glass fiber-reinforced resin sheet of the present embodiment includes a resin or a resin composition comprising a resin and additives, in addition to the glass roving cloth of the present embodiment described above.

In the glass fiber-reinforced resin sheet of the present embodiment, 1 or 2 to 15 of the glass roving cloths of the present embodiment described above may be included in lamination. From the viewpoint of achieving both the mechanical strength and shape-imparting property of the glass fiber-reinforced resin sheet in a well-balanced manner, in the glass fiber-reinforced resin sheet of the present embodiment, 3 to 10 of the glass roving cloths of the present embodiment am preferably included in lamination.

In the glass fiber-reinforced resin sheet of the present embodiment, the proportion by mass of the glass roving cloth of the present embodiment (when a plurality of the glass roving cloths are included, the total mass thereof) (hereinafter, may be referred to as the glass content) may be in the range of 10.0 to 90.0% by mass based on the total amount of the glass fiber-reinforced resin sheet. From the viewpoint of achieving both the mechanical strength and the shape-imparting property of the glass fiber-reinforced resin sheet of the present embodiment in a well-balanced manner, the glass content is preferably in the range of 50.0 to 85.0% by mass, more preferably in the range of 55.0 to 80.0% by mass, and further preferably in the range of 60.0 to 75.0% by mass.

In the glass fiber-reinforced resin sheet of the present embodiment, the proportion by mass of the glass roving cloth of the present embodiment with respect to the glass fiber-reinforced resin sheet of the present embodiment can be calculated in compliance with JIS K 7052:1999.

In the glass fiber-reinforced resin sheet of the present embodiment, the resin or the resin composition may be included in the glass roving cloth of the present embodiment via impregnation, partial impregnation, or surface application. In the glass fiber-reinforced resin sheet, the resin or the resin composition may be dried or cured or may be semi-dried or semi-cured. From the viewpoint of enhancing the stability of the mechanical properties and quality of the glass fiber-reinforced resin sheet, the glass roving cloth of the present embodiment is impregnated with the resin or the resin composition, which is then preferably dried or cured. Meanwhile, from the viewpoint of enhancing the shape-imparting property and the handleability of the glass fiber-reinforced resin sheet, the glass roving cloth of the present embodiment is partially impregnated with the resin or the resin composition, which is then preferably semi-dried or semi-cured into a highly flexible state (semi-peg state).

In the glass fiber-reinforced resin sheet of the present embodiment, the resin may be a thermoplastic resin or a thermosetting resin.

Examples of the above thermoplastic resin can include polyethylene, polypropylene, polystyrene, styrene/maleic anhydride resins, styrene/maleimide resins, polyacrylonitrile, acrylonitrile/styrene (AS) resins, acrylonitrile/butadiene/styrene (ABS) resins, chlorinated polyethylene/acrylonitrilelstyrene (ACS) resins, acrylonitrile/ethylene/styrene (AES) resins, acrylonitrile/styrene/methyl acrylate (ASA) resins, styrenelacrylonitrile (SAN) resins, methacrylic resins, polyvinyl chloride (PVC), polyvinylidene chloride (PVDC), polyarn ide, polyacetal, polyethylene terephthalate (PET), polybutylene terephthalate (PBT), polytrimethylene terephthalate (IT), polycarbonate, polyarylene sulfide, polyethersulfone (PES), polyphenylsulfone (PPSU), polyphenylene ether (PPE), modified polyphenylene ether (m-PPE), polyaryletherketone, liquid crystal polymer (LCP), fluororesins, polyetherimide (PE), polyarylate (PAR), polysulfone (PSF), polyarn ideimide (PAI), polyarn inobismaleimide (PABM), thermoplastic polyimide (TPI), polyethylene naphthalate (PEN), ethylene/vinyl acetate (EVA) resins, ionomer (IO) resins, polybutadiene, styrene/butadiene resins, polybutylene, polymethylpentene, olefin/vinyl alcohol resins, cyclic olefin resins, cellulose resins, and polylactic acid.

Specific examples of the polyethylene include high density polyethylene (HDPE), medium density polyethylene, low density polyethylene (LDPE), linear low density polyethylene (LLDPE), and ultra-high molecular weight polyethylene.

Examples of the polypropylene include isotactic polypropylene, atactic polypropylene, syndiotactic polypropylene, and mixtures thereof.

Examples of the polystyrene include general-purpose polystyrene (GPPS), which is an atactic polystyrene having an atactic structure, high impact polystyrene (HIPS) with a rubber component added to GPPS, and syndiotactic polystyrene having a syndiotactic structure.

Examples of the methacrylic resin include polymers obtained by homopolymerizing one of acrylic acid, methacrylic acid, styrene, methyl acrylate, ethyl acrylate, ethyl methacrylate, butyl acrylate, butyl methacrylate, and fatty acid vinyl ester, or polymers obtained by copolymerizing two or more of these.

Examples of the polyvinyl chloride include a vinyl chloride homopolymer, a copolymer of a vinyl chloride monomer and a copolymerizable monomer, or a graft copolymer obtained by graft polymerization of a vinyl chloride monomer to polymer polymerized by a conventionally known method such as emulsion polymerization method, suspension polymerization method, micro suspension polymerization method, or bulk polymerization method.

Examples of the polyarn ide can include one of components such as polycaproamide (nylon 6), polyhexamethylene adipamide (nylon 66), polytetamethylene adipamide (nylon 46), polytetramethylene sebacamide (nylon 410), polypentamethylene adipamide (nylon 56), polypentamethylene sebacamide (nylon 510), polyhexamethylene sebacamide (nylon 610), polyhexamethylene dodecamide (nylon 612), polydecamethylene adipamide (nylon 106), polydecamethylene sebacamide (nylon 1010), polydecamethylene dodecamide (Nylon 1012), polyundecanamide (Nylon 11), polyundecamethylene adipamide (Nylon 116), polydodecanamide (Nylon 12), polyxylene adipamide (nylon XD6), polyxylene sebacamide (nylon XD10), polymetaxylylene adipamide (nylon MXD6), polyparaxylylene adipamide (nylon PXD6), polytetramethylene terephthalamide (nylon 4T), polypentanethylene terephthalamide (nylon 5T), polyhexamethylene terephthalamide (nylon 6T), polyhexamethylene isophthalamide (nylon 61), polynonamethylene terephthalamide (nylon 9T) polydecamethylene terephthalamide (nylon 10T), polyundecamethylene terephthalamide (nylon 11T), polydodecamethylene terephthalamide (nylon 12T), polytetramethylene isophthalamide (nylon 4I), polybis (3-methyl-4-aminohexyl) methane terephthalamide (nylon PACMT), polybis(3-methyl-4-aminohexyl) methane isophthalamide (nylon PACMI), polybis(3-methyl-4-aminohexyl) methane dodecamide (nylon PACM12), and polybis(3-methyl-4-aminohexyl) methane tetradecamide (nylon PACM14), or copolymers obtained by combining two or more of the components, and mixtures thereof.

Examples of the polyacetal include a homopolymer with oxymethylene units as the main repeating unit, and a copolymer mainly composed of oxymethylene units and containing oxyalkylene units having 2 to 8 adjacent carbon atoms in the main chain.

Examples of the polyethylene terephthalate include polymers obtained by polycondensation of terephthalic acid or a derivative thereof with ethylene glycol.

Examples of the polybutylene terephthalate include polymers obtained by polycondensation of terephthalic acid or a derivative thereof with 1,4-butanediol.

Examples of the polytrimethylene terephthalate include polymers obtained by polycondensation of terephthalic acid or a derivative thereof with 1,3-propanediol.

Examples of the polycarbonate include polymers obtained by a transesterification method in which a dihydroxydiaryl compound is reacted with a carbonate such as diphenyl carbonate in a molten state; or polymers obtained by phosgene method in which a dihydroxyaryl compound is reacted with phosgene.

Examples of the polyarylene sulfide include linear polyphenylene sulfide, crosslinked polyphenylene sulfide having a high molecular weight obtained by performing a curing reaction after polymerization, polyphenylene sulfide sulfone, polyphenylene sulfide ether, and polyphenylene sulfide ketone.

Examples of the modified polyphenylene ether include: a polymer alloy of poly(2,6-dimethyl-1,4-phenylene)ether and polystyrene; a polymer alloy of poly(2,6-dimethyl-1,4-phenylene)ether and a styrene/butadiene copolymer; a polymer alloy of poly(2,6-dimethyl-1,4-phenylene)ether and a styrene/maleic anhydride copolymer; a polymer alloy of poly(2,6-dimethyl-1,4-phenylene)ether and polyarn ide; and a polymer alloy of poly(2,6-dimethyl-1,4-phenylene)ether and styrene/butadiene/acrylonitrile copolymer.

Examples of the polyaryletherketone include polyetherketone (PEK), polyethemtherketone (PEEK), polyetherketoneketone (PEKK), and polyethemtherketoneketone (PEEKK).

Examples of the liquid crystal polymer (LCP) include a polymer (copolymer) composed of one or more structural units selected from aromatic hydroxycarbonyl units which are thermotropic liquid crystal polyesters, aromatic dihydroxy units, aromatic dicarbonyl units, aliphatic dihydroxy units, and aliphatic dicarbonyl units.

Examples of the fluororesin include polytetrafluoroethylene (PTFE), perfluoroalkoxy resins (PFA), fluorinated ethylene propylene resins (FEP), fluorinated ethylene tetrafluoroethylene resins (ETFE), polyvinyl fluoride (PVF), polyvinylidene fluoride (PVDF), polychlorotrifluoroethylene (PCTFE), and ethylene/chlorotrifluoroethylene resin (ECTFE).

Examples of the ionomer (IO) resin include copolymers of an olefin or a styrene and an unsaturated carboxylic acid, wherein a part of carboxyl groups is neutralized with a metal ion.

Examples of the olefin/vinyl alcohol resin include ethylene/vinyl alcohol copolymers, propylene/vinyl alcohol copolymers, saponified products of ethylene/vinyl acetate copolymers, and saponified products of propylene/vinyl acetate copolymers.

Examples of the cyclic olefin resin include monocyclic compounds such as cyclohexene, polycyclic compounds such as tetracyclopentadiene, and polymers of cyclic olefin monomers.

Examples of the polylactic acid include poly-L-lactic acid, which is a homopolymer of L-form, poly-D-lactic acid, which is a homopolymer of D-form, or a stereocomplex polylactic acid which is a mixture thereof.

Examples of the cellulose resin can include methylcellulose, ethylcellulose, hydroxycellulose, hydroxymethylcellulose, hydroxyethylcellulose, hydroxyethyl methylcellulose, hydroxypropyl methylcellulose, cellulose acetate, cellulose propionate, and cellulose butyrate.

Examples of the above thermosetting resin can include unsaturated polyester resins, vinyl ester resins, epoxy (EP) resins, melamine (MF) resins, phenol resins (PF), urethane resins (PU), polyisocyanate, polyisocyanurate, polyimide (PI), urea (UF) resins, silicon (SI) resins, furan (FR) resins, benzoguanamine (BR) resins, alkyd resins, xylene resins, bismaleide triazine (BT) resins, and diallyl phthalate resin (PDAP).

Specific examples of the unsaturated polyester include resins obtained by esterification reaction of aliphatic unsaturated dicarboxylic acid and aliphatic diol.

Examples of the vinyl ester resin include bis vinyl ester resins and novolac vinyl ester resins.

Examples of the epoxy resin include bisphenol A epoxy resins, bisphenol F epoxy resins, bisphenol E epoxy resins, bisphenol S epoxy resins, bisphenol M epoxy resins (4,4'-(1,3-phenylenediisopropylidene)bisphenol epoxy resins), bisphenol P epoxy resins (4,4'-(1,4-phenylenediisopropylidene)bisphenol epoxy resins), bisphenol Z epoxy resins (4,4'-cyclohexadiene bisphenol epoxy resins), phenol novolac epoxy resins, cresol novolac epoxy resins, tetraphenol group ethane novolac epoxy resins, novolac epoxy resins having a condensed ring aromatic hydrocarbon structure, biphenyl epoxy resins, aralkyl epoxy resins such as xylylene epoxy resins and phenyl aralkyl epoxy resins, naphthylene ether epoxy resins, naphthol epoxy resins, naphthalene diol epoxy resins, bifunctional or tetrafunctional epoxy naphthalene resins, binaphthyl epoxy resins, naphthalene aralkyl epoxy resins, anthracene epoxy resins, phenoxy epoxy resins, dicyclopentadiene epoxy resins, norbornene epoxy resins, adamantane epoxy resins, and fluorene epoxy resins.

Examples of the melamine resin include a polymer formed by polycondensation of melamine (2,4,6-triamino-1,3,5-triazine) and formaldehyde.

Examples of the phenolic resin include novolac phenolic resins such as phenol novolac resins, cresol novolac resins, and bisphenol A novolac resins, resol phenol resins such as methylol resole resins and dimethylene ether resole resins, or aryl alkylene phenol resins, and include one of these or combinations of two or more.

Examples of the urea resin include a resin obtained by condensation of urea and formaldehyde.

The above thermoplastic resin or the above thermosetting resin may be used singly or in combinations of two or more.

The resin used in the glass fiber-reinforced resin sheet of the present embodiment is preferably a thermoplastic resin from the viewpoint of handleability and recyclability after formed into the sheet, and diverse molding methods. Among thermoplastic resins, resins selected from the group consisting of a polyarn ide resin, a polypropylene resin, a polycarbonate resin, a polyphenylene sulfide resin, and a polyetheretherketone resin are more preferable because of being excellent in physical properties such as mechanical strength and heat resistance. Among these, a polyarn ide resin or a polypropylene resin is further preferable, and a polyarn ide resin is particularly preferred, from the viewpoint of being excellent in versatility and handleability.

Examples of additives that may be included in the resin composition can include reinforcing fiber (e.g., glass fiber, carbon fiber, and metal fiber), a filler (e.g., glass powder, talc, and mica), a flame retardant, an UV absorber, a heat stabilizer, an antioxidant, an antistatic agent, a fluidity improver, an anti-blocking agent, a lubricant, a nucleating agent, an antibacterial agent, and a pigment. These additives may be contained in an amount ranging from 0.1 to 50.0% by mass based on the total amount of the resin composition in the resin composition.

The glass fiber-reinforced resin sheet of the present embodiment can be obtained by, for example, a method in which the glass roving cloth of the present embodiment and a resin film are laminated and being heated and pressurized while passed through between 2 rolls (a double-belt press method). The glass fiber-reinforced resin sheet of the present embodiment also can be obtained by uniformly applying the glass roving cloth of the present embodiment with a resin powder and heating the glass roving cloth.

Examples of applications of the glass fiber-reinforced resin sheet of the present embodiment include, but are not limited to, metal substitute materials for automobiles. The glass fiber-reinforced resin sheet of the present embodiment can be used in, for example, housings of electrical and electronic devices, structures of household electric appliances, sporting equipment, structures and constituent members of projectiles (aircrafts and drones), and the like.

Examples and Comparative Examples of the present invention will be shown.

EXAMPLES

Example 1

Glass rovings formed of 2000 glass filaments each having a filament diameter of 17 μm having the E glass composition bundled, having a number of twists of 0.10 twists/25 mm, and including 0.20% by mass of a silane coupling agent attached thereto based on the mass thereof (glass direct roving) were used as warp yarns and weft yarns. The glass rovings as the warp yarns and weft yarns were 2/2 twill-weaved at a warp yarn weaving density Wt of 7.0 yarns/25 mm and a weft yarn weaving density Wy of 6.5 yarns/25 mm using a rapier loom to obtain a glass roving cloth. This glass roving cloth was subjected to opening treatment by means of a water flow pressure set at 1.0 MPa to obtain a glass roving cloth of Example 1.

The warp yarn average yarn width Bt, weft yarn average yarn width By, thickness, mass per unit area, and loss on ignition of the glass roving cloth of Example 1 were measured according to the methods described above. Additionally, the weaving performance and resin impregnability of the glass roving cloth of Example 1 were evaluated according to the following methods. The results are shown in Table 1.

[Evaluation of Weaving Performance]

A case where the number of occurrences of weft yarn beating failure due to fuzz was less than 1/50 m and no bowed filling occurred in the warp yarns and weft yarns was evaluated as "A". A case where the number of occurrences of weft yarn beating failure due to fuzz on weaving was 1 to 5/50 m or more and no bowed filling occurred in the warp yarns and weft yarns was evaluated as "B". A case where the number of occurrences of weft yarn beating failure due to fuzz on weaving was more than 5/50 m or more, or bowed filling occurred in the warp yarns and weft yarns was evaluated as "C".

[Evaluation of Resin Impregnability]

While 4 of the glass roving cloths of Example 1 were laminated, a polyarn ide resin powder (manufactured by Toray Industries, Inc., trade name: 1001P, denoted by "PA" in Table 1) was uniformly sprayed between these layers such that the glass content reached 70.0% by mass. Then, the laminate was pressed in a high-temperature pressing machine under conditions of a temperature of 250° C. and a pressure time of 10 minutes to obtain a glass fiber-reinforced resin sheet of Example 1. In a case where a transparent glass-state portion, which was not impregnated with the resin, did not remain in the resulting glass fiber-reinforced resin sheet, the resin impregnability was regarded as "acceptable". In a case where such a portion remained, the resin impregnability was regarded as "unacceptable".

The bending strength and flexural modulus of the glass fiber-reinforced resin sheet of Example 1 were measured according to the methods described above. Additionally, the shape-imparting property of the glass fiber-reinforced resin sheet of Example 1 was evaluated according to the following method. The results are shown in Table 1.

[Evaluation of Shape-Imparting Property]

The glass fiber-reinforced resin sheet was subjected to compression pressing using a hemispherical metal mold. In a case where a hemispherical shape was obtained, and the glass roving cloth of the glass fiber-reinforced resin sheet had no wrinkle and exhibited a good appearance, the shape-imparting property was evaluated as "A". In a case where a hemispherical shape was obtained, but the glass roving cloth of the glass fiber-reinforced resin sheet has a wrinkle and exhibits an unsatisfactory appearance, the shape-imparting property was evaluated as "B". In a case where no sufficient hemispherical shape was obtained, the shape-imparting property was evaluated as "C".

Example 2

Glass rovings formed of 2000 glass filaments each having a filament diameter of 17 μm having the E glass composition bundled, having a number of twists of 0.10 twists/25 mm, and including 0.12% by mass of a silane coupling agent attached thereto based on the mass thereof were used as warp yarns and weft yarns. The glass rovings as the warp yarns and weft yarns were 2/2 twill-weaved at a warp yarn weaving density Wt of 7.0 yarns/25 mm and a weft yarn weaving density Wy of 6.5 yarns/25 mm using a rapier loom to obtain a glass roving cloth. This glass roving cloth was subjected to opening treatment by means of a water flow pressure set at 1.0 MPa to obtain a glass roving cloth of Example 2.

The warp yarn average yarn width Bt, weft yarn average yarn width By, thickness, mass per unit area, and loss on ignition of the glass roving cloth of Example 2 were measured and the weaving performance and resin impregnability thereof were evaluated, exactly in the same manner as in Example 1. The results are shown in Table 1.

Subsequently, a glass fiber-reinforced resin sheet of Example 2 was produced exactly in the same manner as in Example 1 except that the glass roving cloth of Example 2 was used. The bending strength and flexural modulus of the glass fiber-reinforced resin sheet of Example 2 were measured, and the shape-imparting property thereof was evaluated. The results are shown in Table 1.

Example 3

Glass rovings formed of 2000 glass filaments each having a filament diameter of 17 μm having the E glass composition bundled, having a number of twists of 0.10 twists/25 mm, and including 0.40% by mass of a silane coupling agent attached thereto based on the mass thereof were used as warp yarns and weft yarns. The glass rovings as the warp yarns and weft yarns were 2/2 twill-weaved at a warp yarn weaving density Wt of 7.0 yarns/25 mm and a weft yarn weaving density Wy of 6.5 yarns/25 mm using a rapier loom to obtain a glass roving cloth. This glass roving cloth was subjected to opening treatment by means of a water flow pressure set at 1.0 MPa to obtain a glass roving cloth of Example 3.

The warp yarn average yarn width Bt, weft yarn average yarn width By, thickness, mass per unit area, and loss on ignition of the glass roving cloth of Example 3 were measured and the weaving performance and resin impregnability thereof were evaluated, exactly in the same manner as in Example 1. The results are shown in Table 1.

Subsequently, a glass fiber-reinforced resin sheet of Example 3 was produced exactly in the same manner as in Example 1 except that the glass roving cloth of Example 3 was used. The bending strength and flexural modulus of the glass fiber-reinforced resin sheet of Example 3 were measured, and the shape-imparting property thereof was evaluated. The results are shown in Table 1.

Example 4

Glass rovings formed of 2000 glass filaments each having a filament diameter of 17 μm having the E glass composition bundled, having a number of twists of 0.10 twists/25 mm, and including 0.20% by mass of a silane coupling agent attached thereto based on the mass thereof were used as warp yarns and weft yarns. The glass rovings as the warp yarns and weft yarns were ⅓ twill-weaved at a warp yarn weaving density Wt of 7.0 yarns/25 mm and a weft yarn weaving density Wy of 6.5 yarns/25 mm using a rapier loom to obtain a glass roving cloth. This glass roving cloth was subjected to opening treatment by means of a water flow pressure set at 1.0 MPa to obtain a glass roving cloth of Example 4.

The warp yarn average yarn width Bt, weft yarn average yarn width By, thickness, mass per unit area, and loss on ignition of the glass roving cloth of Example 4 were measured and the weaving performance and resin impregnability thereof were evaluated, exactly in the same manner as in Example 1. The results are shown in Table 1.

Subsequently, a glass fiber-reinforced resin sheet of Example 4 was produced exactly in the same manner as in Example 1 except that the glass roving cloth of Example 4 was used. The bending strength and flexural modulus of the glass fiber-reinforced resin sheet of Example 4 were measured, and the shape-imparting property thereof was evaluated. The results are shown in Table 1.

Comparative Example 1

Glass rovings formed of 2000 glass filaments each having a filament diameter of 17 μm having the E glass composition bundled, having a number of twists of 0.10 twists/25 mm, and including 0.20% by mass of a silane coupling agent attached thereto based on the mass thereof were used as warp yarns and weft yarns. The glass rovings as the warp yarns and weft yarns were 2/2 twill-weaved at a warp yarn weaving density Wt of 7.0 yarns/25 mm and a weft yarn weaving density Wy of 6.5 yarns/25 mm using a rapier loom to obtain a glass roving cloth. This glass roving cloth was subjected to opening treatment by means of a water flow pressure set at 3.0 MPa to obtain a glass roving cloth of Comparative Example 1.

The warp yarn average yarn width Bt, weft yarn average yarn width By, thickness, mass per unit area, and loss on ignition of the glass roving cloth of Comparative Example 1 were measured and the weaving performance and resin impregnability thereof were evaluated, exactly in the same manner as in Example 1. The results are shown in Table 1.

Subsequently, a glass fiber-reinforced resin sheet of Comparative Example 1 was produced exactly in the same manner as in Example 1 except that the glass roving cloth of Comparative Example 1 was used. The bending strength and flexural modulus of the glass fiber-reinforced resin sheet of Comparative Example 1 were measured, and the shape-imparting property thereof was evaluated. The results are shown in Table 1.

Comparative Example 2

Glass rovings formed of 2000 glass filaments each having a filament diameter of 17 μm having the E glass composition bundled, having a number of twists of 0.10 twists/25 mm, and including 0.20% by mass of a silane coupling agent attached thereto based on the mass thereof were used as warp yarns and weft yarns. The glass rovings as the warp yarns and weft yarns were plain-weaved at a warp yarn weaving density Wt of 7.0 yarns/25 mm and a weft yarn weaving density Wy of 6.5 yarns/25 mm using a rapier loom to obtain a glass roving cloth. This glass roving cloth was subjected to opening treatment by means of a water flow pressure set at 1.0 MPa to obtain a glass roving cloth of Comparative Example 2.

The warp yarn average yarn width Bt, weft yarn average yarn width By, thickness, mass per unit area, and loss on ignition of the glass roving cloth of Comparative Example 2 were measured and the weaving performance and resin impregnability thereof were evaluated, exactly in the same manner as in Example 1. The results are shown in Table 1.

Subsequently, a glass fiber-reinforced resin sheet of Comparative Example 2 was produced exactly in the same manner as in Example 1 except that the glass roving cloth of Comparative Example 2 was used. The bending strength and flexural modulus of the glass fiber-reinforced resin sheet of Comparative Example 2 were measured, and the shape-imparting property thereof was evaluated. The results are shown in Table 1.

Comparative Example 3

Glass roving formed of 1000 glass filaments each having a filament diameter of 17 μm having the E glass composition bundled, having a number of twists of 0.10 twists/25 mm, and including 0.20% by mass of a silane coupling agent attached thereto based on the mass thereof were used as warp yarns and weft yarns. The glass rovings as the warp yarns and weft yarns were ⅓ twill-weaved at a warp yarn weaving density Wt of 14.0 yarns/25 mm and a weft yarn weaving density Wy of 13.0 yarns/25 mm using a rapier loom to obtain a glass roving cloth. This glass roving cloth was subjected to opening treatment by means of a water flow pressure set at 1.0 MPa to obtain a glass roving cloth of Comparative Example 3.

The warp yarn average yarn width Bt, weft yarn average yarn width By, thickness, mass per unit area, and loss on ignition of the glass roving cloth of Comparative Example 3 were measured and the weaving performance and resin impregnability thereof were evaluated, exactly in the same manner as in Example 1. The results are shown in Table 1.

Subsequently, a glass fiber-reinforced resin sheet of Comparative Example 3 was produced exactly in the same manner as in Example 1 except that the glass roving cloth of Comparative Example 3 was used. The bending strength and flexural modulus of the glass fiber-reinforced resin sheet of Comparative Example 3 were measured, and the shape-imparting property thereof was evaluated. The results are shown in Table 1.

TABLE 1

| | | Example | | | | Comparative Example | | |
|---|---|---|---|---|---|---|---|---|
| | | 1 | 2 | 3 | 4 | 1 | 2 | 3 |
| Glass roving cloth | Warp yarn filament diameter Dt (μm) | 17.0 | 17.0 | 17.0 | 17.0 | 17.0 | 17.0 | 17.0 |
| | Number of warp yarn filaments Ft (filaments) | 2000 | 2000 | 2000 | 2000 | 2000 | 2000 | 1000 |
| | Number of twists of warp yarn (twists/25 mm) | 0.10 | 0.10 | 0.10 | 0.10 | 0.10 | 0.10 | 0.10 |
| | Weaving density of warp yarns Wt (yarns/25 mm) | 7.0 | 7.0 | 7.0 | 7.0 | 7.0 | 7.0 | 14.0 |
| | Warp yarn average yarn width Bt (μm) | 3600 | 3600 | 3600 | 3400 | 4000 | 3100 | 1800 |
| | Warp yarn widening rate Et (=100 × Bt/(Dt × Ft); %) | 10.6 | 10.6 | 10.6 | 10.0 | 11.8 | 9.1 | 10.6 |
| | Glass occupancy in warp yarn direction Mt (=100 × Bt/(25000)/Wt; %) | 100.8 | 100.8 | 100.8 | 95.2 | 112 | 86.8 | 100.8 |
| | Weft yarn filament diameter Dy (μm) | 17.0 | 17.0 | 17.0 | 17.0 | 17.0 | 17.0 | 17.0 |
| | Number of weft yarn filaments Fy (filaments) | 2000 | 2000 | 2000 | 2000 | 2000 | 2000 | 1000 |
| | Number of twists of weft yarn (twists/25 mm) | 0.10 | 0.10 | 0.10 | 0.10 | 0.10 | 0.10 | 0.10 |
| | Weaving density of weft yarns Wy (yarns/25 mm) | 6.5 | 6.5 | 6.5 | 6.5 | 6.5 | 6.5 | 13 |
| | Weft yarn average yarn width By (μm) | 3600 | 3600 | 3600 | 2900 | 4000 | 3100 | 1400 |
| | Weft yarn widening rate Ey (=100 × By/(Dy × Fy); %) | 10.6 | 10.6 | 10.6 | 8.5 | 11.8 | 9.1 | 8.2 |
| | Glass occupancy in weft yarn direction My (=100 × By/(25000)/Wy; %) | 93.6 | 93.6 | 93.6 | 75.4 | 104 | 80.6 | 72.8 |
| | Wy/Wt | 0.93 | 0.93 | 0.93 | 0.93 | 0.93 | 0.93 | 0.93 |
| | By/Bt | 1.00 | 1.00 | 1.00 | 0.85 | 1.00 | 1.00 | 0.78 |
| | Thickness (μm) | 700 | 700 | 700 | 700 | 700 | 600 | 700 |
| | Mass per unit area (g/m2) | 630 | 630 | 630 | 630 | 630 | 630 | 630 |
| | Loss on ignition (%) | 0.20 | 0.12 | 0.40 | 0.20 | 0.20 | 0.20 | 0.20 |
| Glass fiber-reinforced resin sheet | Number of glass roving cloths laminated (cloths) | 4 | 4 | 4 | 4 | 4 | 4 | 4 |
| | Resin | PA | PA | PA | PA | PA | PA | PA |
| | Glass content (% by mass) | 70.0 | 70.0 | 70.0 | 70.0 | 70.0 | 700 | 70.0 |
| Weaving performance of glass roving cloth | | A | B | A | A | C | A | A |
| Resin impregnability of glass roving cloth | | Acceptable | Acceptable | Acceptable | Acceptable | Acceptable | Acceptable | Unacceptable |
| Shape-imparting property of glass fiber-reinforced resin sheet | | A | A | A | A | B | C | A |
| Bending strength of glass fiber-reinforced resin sheet (MPa) | | 660 | 555 | 603 | 612 | 658 | 599 | 530 |
| Flexural modulus of glass fiber-reinforced resin sheet (GPa) | | 21.2 | 21.0 | 21.0 | 20.0 | 20.3 | 20.9 | 20.4 |

As shown in Table 1, the glass roving cloths represented in Examples 1 to 4 each comprise glass rovings each composed of glass filaments, each having a filament diameter Dt in the range of 9.5 to 30.0 μm, bundled in a number bundled Ft in the range of 400 to 8000 as warp yarns and glass rovings each composed of glass filaments, each having a filament diameter Dy in the range of 9.5 to 30.0 μm, bundled in a number bundled Fy in the range of 400 to 8000 as weft yarns, wherein the weaving density of the warp yarns Wt and the weaving density of the weft yarns Wy are each in the range of 2.0 to 14.0 yarns/25 mm, the warp yarn average yarn width Bt and the weft yarn average yarn width By are each in the range of 500 to 8000 μm, the warp yarn widening rate Et (100×Bt/(Dt×Ft)) and the weft yarn widening rate Ey (100×By/(Dy×Fy)) ax each in the range of 3.0 to 30.0%, the glass occupancy in the warp yarn direction Mt (100×Bt/(25000 (μm)/Wt)) is in the range of 90.0 to 106.0%, and the glass occupancy in the weft yarn direction My (100×By/(25000 (μm)/Wy)) is in the range of 75.0 to 99.0%. The glass roving cloths represented in Examples 1 to 4 comprise excellent weaving performance and excellent resin impregnability. The glass fiber-reinforced resin sheets each including the corresponding glass roving cloth comprise high mechanical strength, that is, a bending strength of 600 MPa or more and a flexural modulus of 20.0 GPa or more, and an excellent shape-imparting property.

The glass roving cloths represented in Examples 1 to 3, in which the Mt is in the range of 98.0 to 105.0% and the My is in the range of 80.0 to 98.0%, comprise excellent weaving performance and excellent resin impregnability. The glass fiber-reinforced resin sheets each including the corresponding glass roving cloth comprise higher mechanical strength, that is, a bending strength of 600 MPa or more and a flexural modulus of 20.5 GPa or more and an excellent shape-imparting property.

Further, the glass roving cloth represented in Example 1, in which the Mt is in the range of 98.0 to 105.0%, the My is in the range of 80.0 to 98.0%, and the loss on ignition is in the range of 0.16 to 0.30%, comprises extremely excellent weaving performance and excellent resin impregnability. The glass fiber-reinforced resin sheet including the corresponding glass roving cloth comprises extremely high mechanical strength, that is, a bending strength of 630 MPa or more and a flexural modulus of 20.5 GPa or more, and an excellent shape-imparting property.

In contrast, the glass roving cloths of Comparative Examples 1 to 3 do not satisfy the requirements described above. Thus, the glass roving cloths of Comparative Examples 1 to 3 do not comprise sufficient weaving performance or resin impregnability, or the glass fiber-reinforced resin sheets each including the corresponding glass roving cloth do not comprise sufficient mechanical strength or a sufficient shape-imparting property.

The invention claimed is:

1. A glass roving cloth comprising:

a warp yarn; and a weft yarn, the warp yarns being glass rovings each comprising glass filaments, each having a filament diameter Dt in a range of 9.5 to 30.0 μm, bundled in a number bundled Ft in a range of 400 to 8000, the weft yarns being glass rovings each comprising glass filaments, each having a filament diameter Dy in a range of 9.5 to 30.0 μm, bundled in a number bundled Fy in a range of 400 to 8000, wherein a weaving density of the warp yarns Wt and a weaving density of the weft yarns Wy are each in a range of 2.0 to 14.0 yarns/25 mm, a warp yarn average yarn width Bt and a weft yarn average yarn width By are each in a range of 500 to 8000 μm, a warp yarn widening rate Et (100×Bt/(Dt×Ft)) and a weft yarn widening rate Ey (100×By/(Dy×Fy)) are each in the range of 3.0 to 30.0%, a glass occupancy in a warp yarn direction Mt (100×Bt/(25000 (μm)/Wt)) is in a range of 90.0 to 106.0%, and a glass occupancy in a weft yarn direction My (100×By/(25000 (μm)/Wy)) is in a range of 75.0 to 99.0%.

2. The glass roving cloth according to claim 1, wherein the Mt is in a range of 98.0 to 105.0%, and the My is in a range of 80.0 to 98.0%.

3. The glass roving cloth according to claim 1, wherein a loss on ignition of the glass roving cloth is 0.16 to 0.30%.

4. The glass roving cloth according to claim 1, wherein the Et and Ey are each in a range of 7.0 to 11.4%.

5. A glass fiber-reinforced resin sheet comprising the glass roving cloth according to claim 1.

6. The glass fiber-reinforced resin sheet according to claim 5, wherein a proportion by mass of the glass roving cloth based on a total amount of the glass fiber-reinforced resin sheet is 50.0 to 85.0% by mass.

* * * * *